United States Patent [19]

Gilham et al.

[11] Patent Number: 4,724,759

[45] Date of Patent: Feb. 16, 1988

[54] ROTARY FRANKING MACHINE

[75] Inventors: Dennis T. Gilham, Brentwood; Thomas D. Williams, Billericay, both of England

[73] Assignee: Roneo Alcatel Limited, Romford, England

[21] Appl. No.: 28,752

[22] Filed: Mar. 23, 1987

[30] Foreign Application Priority Data

Mar. 25, 1986 [GB] United Kingdom ..... 8607366

[51] Int. Cl.[4] ..... G07B 17/02; B41J 29/00

[52] U.S. Cl. ..... 101/91; 235/101

[58] Field of Search ..... 101/91; 400/663; 235/101

[56] References Cited

U.S. PATENT DOCUMENTS 3,848,798 11/1974 Riley ..... 235/101

FOREIGN PATENT DOCUMENTS 2048784 12/1980 United Kingdom ..... 101/91
2055698 3/1981 United Kingdom ..... 101/91
2079223 1/1982 United Kingdom ..... 101/91

*Primary Examiner*—Clifford D. Crowder
*Attorney, Agent, or Firm*—Shoemaker and Mattare, Ltd.

[57] ABSTRACT

A low cost compact franking machine includes a rotatable member comprising a print drum and an enclosure housing print element setting means and electronic accounting means, the rotatable member being rotatably mounted on a base. The rotatable member may be rotated by a manually operated lever coupled to the rotatable member through a one-way clutch to allow the lever to return to a rest position without rotation of the rotatable member, the return of the lever may operate a feed to eject a franked mail item.

15 Claims, 4 Drawing Figures

ROTARY FRANKING MACHINE

BACKGROUND TO THE INVENTION

This invention relates to franking machines for printing a postal franking on mail items.

Franking machines are provided with a print drum carrying printing elements which can be selectively set to print a desired value of postal franking and the date of franking. After setting the printing elements, printing is effected by rotating the drum and pressing an envelope or label against the drum, and the printing elements carried thereby, by means of a pressure roller. Prior to engaging the envelope, the printing elements pass through an inking station where ink is applied to the printing elements. Rotation of the drum together with the pressure roller causes the envelope to be fed therebetween and to be ejected after printing of the franking.

The printing elements, carried by the drum, for printing the franking value are set by means of thumb wheels or similar mechanical setting devices or by means of electromechanical means controlled by electrical signals located on a body of the franking machine. Mechanical linkages are provided between the mechanical setting devices, or the electromechanical means, and the printing elements to enable the printing elements to be set to print the value desired. Due to the need for rotation of the print drum and the printing elements carried thereby relative to the body of the machine, the mechanical linkages have to be constructed to set and maintain the printing elements at the desired settings while at the same time allowing rotation of the print drum. Consequently the mechanical linkages are complex and as a result are expensive to manufacture. Furthermore the linkages occupy a large space within the machine which causes difficulty in manufacturing a compact franking machine.

It is an object of the present invention to provide a construction of franking machine which is less costly to manufacture and is more compact.

SUMMARY OF THE INVENTION

According to the present invention a franking machine comprises a base member; and a rotatable member mounted for rotation on said base member; said rotatable member including a print drum carrying selectively settable printing elements; input means settable to a desired value of franking to be printed; print element setting means operative in response to said input means to set the printing element to the value set by the input means; accounting means responsive to the setting of the input means to register the selected franking value, to carry out accounting functions in relation to said selected franking value and to generate a control signal if the selected franking value is permitted to be printed; and control means normally inhibiting rotation of the rotatable member on said base member and operative in respone to said control signal to free the rotatable member for rotation to effect printing of the selected franking value.

Preferably the accounting means comprises electronic logic circuits operative to register the selected franking value and the accumulated sum of franking values printed by the machine. The accounting means may also include registers to record a value of credit available for use in franking. The rotatable member may carry display means for displaying items of data such as for example the selected franking value, the accumulated sum of franking values printed by the machine, the credit available and instruction data relating to operation of the machine. Such instruction data may indicate malfunctions of the machine and, where the electronic circuits are powered by a battery carried in the rotatable member, may indicate whether the battery voltage lies within specified limits.

The rotatable member may be rotated for printing a franking value by manually operated drive means or by an electrically powered motor mounted on the base member.

The manually operable drive preferably includes a lever rotatable about a pivot on said base member; drive means mechanically coupling said lever to the rotatable member, said drive means being operative upon movement of said lever from a rest position to an operated position to rotate said rotatable member to effect printing of the selected franking value and said drive means including a one way clutch operative to permit return of said lever from said operated position to said rest position without rotation of said rotatable member.

Preferably the franking machine includes feed means coupled to said lever; said feed means being operated by return of said lever from the operated position to the rest position to eject from the machine a mail item upon which the selected franking value has been printed.

The accounting and control means may be powered by an electric battery housed within the rotatable member.

DESCRIPTION OF THE PREFERRED EMBODIMENT

Figure 1:
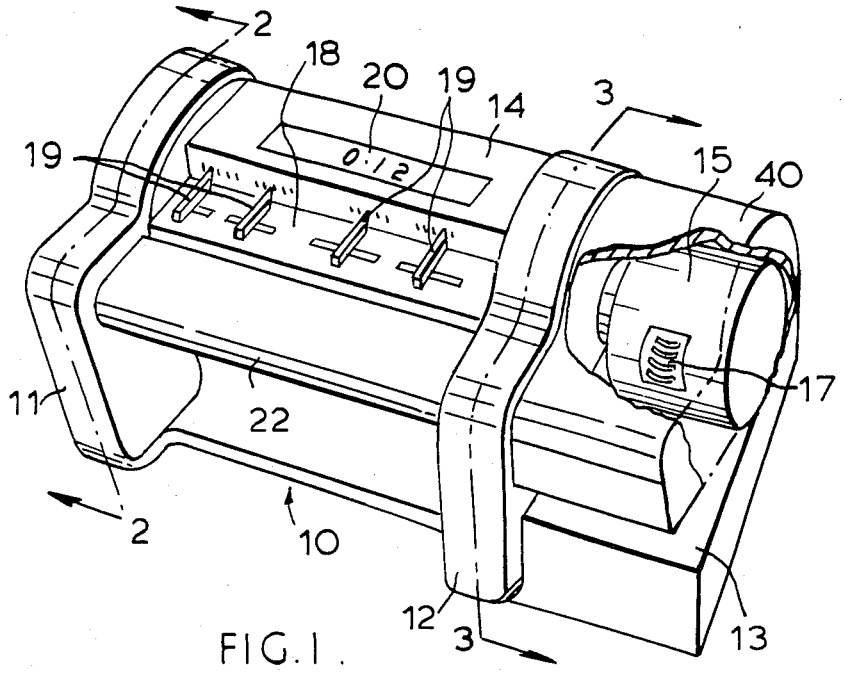
FIG. 1 is an overall view of a manually operable franking machine.

Referring first to FIG. 1, a manually operable franking machine comprises a base member 10 having first and second side casings 11,12. A printing platform 13 extends out from the side casing 12. A rotatable member comprising an enclosure 14 and a print drum 15 is supported for rotation in bearings in the side casings 11,12, The print drum 15 is secured by a hollow shaft 16 (FIG. 3) extending through the end casing 12 to the enclosure 15 of the rotatable member.

The print drum 15 carries within it a set of four printing elements 17 for printing franking values. These elements are in the form of printing wheels selectively settable by rotation thereof to print a selected value. The upper part of the enclosure consists of a facia plate 18 carrying four keys 19 corresponding respectively to the four printing elements. The keys are slidable to set a selected desired value of franking. Adjacent each key are indicia indicating the value to which the key is set. Additionally the facia plate 18 carries a multidigit digital display 20 to enable values registered in an accounting device and other information to be displayed.

Each of the print wheels 17 has a toothed wheel rotatable therewith which is engaged by a toothed rack on one end of a bar 21. The bars 21 extend through the hollow shaft 16 into the interior of the enclosure 14 where they are connected respectively to stems of the keys 19. Because the enclosure 14 is rigidly joined to the print drum 15 and rotates with the drum, the bars 21 can be connected directly to the key stems without the need for the provision of any intermediate connections permitting relative rotation as is the situation in known franking machines. As a result little space is taken up in the enclosure 14 by the elements needed for setting the print wheels. The key stems extend through slots in the facia plate 18 allowing limited sliding motion of the keys. As will be appreciated, sliding movement of a key causes the bar connected thereto to be moved longitudinally relative to the rotatable member and hence the toothed rack at the end of the bar produces rotation of the associated print wheel to a setting in which it will print the value selected by the position of the key 19. In order to prevent erroneous setting of the print wheels to positions intermediate correct positions, a detent rack extends within the enclosure 14 adjacent the key stems and the key stems resiliently engage the rack when released. Prior to sliding a key, it is necessary to depress the key to disengage the stem from the rack and when the key has been moved to a selected position, the stem re-engages the rack when the key is released. Means are provided to sense that the key stem is engaged with a detent in the rack and to inhibit operation of the machine until all the key stems are properly engaged with the rack.

Figure 4:
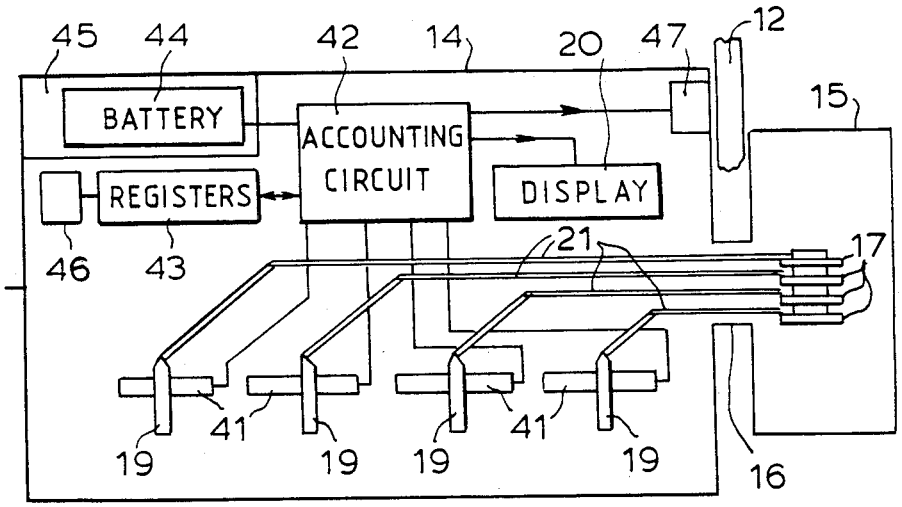
FIG. 4 is a diagrammatic representation of the rotatable member of the franking machine.

Referring to the diagram of FIG. 4, located within the enclosure 14 is an electronic assembly consisting of one or more printed circuit boards carrying electronic components for carrying out accounting operations and for controlling operation of the machine. Sensors 41 are provided for each key 19 to provide electrical signals representing the digital values to which each key has been set and these signals are input as the selected franking value to the accounting logic circuitry 42. Registers 43 are provided for storing the selected franking value, the accumulated sum of franking values previously printed and where appropriate, a register for storing the current value of credit available for use in franking. The electronic circuitry is powered by an electric battery 44 housed within the enclosure 14.

The enclosure may conveniently be of generally cylindrical form. For security, the enclosure is sealed to prevent unauthorised access to its interior. However the battery may be housed in an accessible compartment 45 in the enclosure to permit replacement of the batteries. Those parts of the electronic circuitry such as the registers 43 for storing values for accounting purposes may be implemented by non volatile semiconductor storage elements or those parts of the circuitry may be powered by a separate long life battery 46 within the sealed part of the enclosure. The processor circuitry is arranged to check that the battery voltage lies within preset limits prior to permitting a franking operation to be effected.

In order to carry out a postal franking operation an envelope is placed on the platform 13 and the rotatable member is rotated so as to move the print wheels past an inking device (not shown) and to feed the envelope between the drum and a pressure roll. Hence the drum 15 with the print wheels 17 rolls along the face of the envelope and prints the franking thereon.

Normally rotation of the rotatable member is prevented by means of a catch 47 engaging between the base 10 and the enclosure 14 of the rotatable member. When it is desired to effect a franking operation, the keys are set to the required franking value and the processing circuitry carries out a check to establish that the keys are correctly set relative to the detent rack, that the required value is a permitted value, that the accumulated franking value does not exceed a predetermined limit and that there is sufficient credit for this currently required franking. If the results of these checks are satisfactory an output signal is generated to release the catch 47 and thereby permit the rotatable member to be rotated. After rotation to effect a franking, the catch re-engages to prevent further franking until the checks have been repeated.

Figure 2:
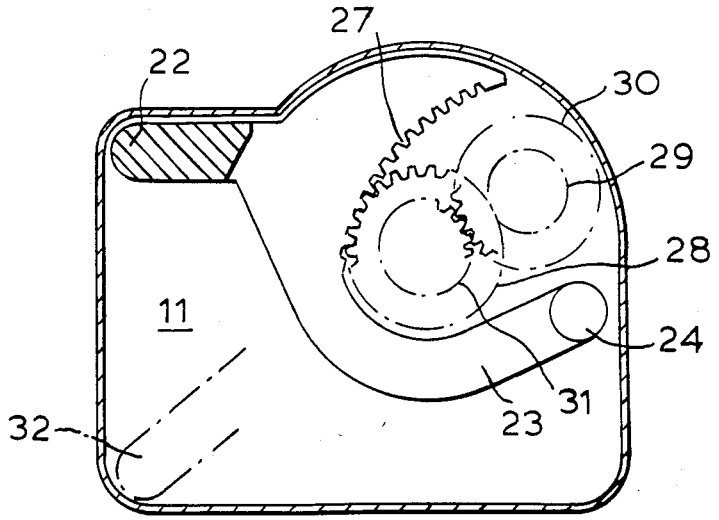
FIG. 2 is a sectional view on the line 2—2 of FIG. 1 of one side casing illustrating the construction of a manual drive for the franking machine.
Figure 3:
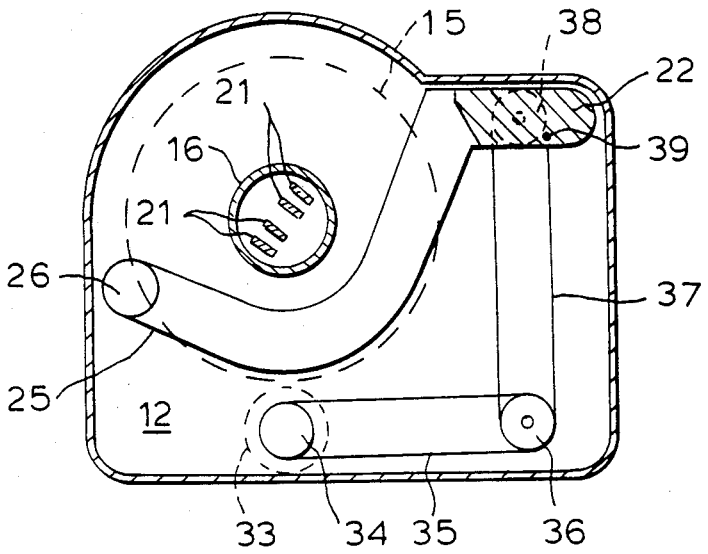
FIG. 3 is a sectional view on the line 3—3 of FIG. 1 of the other side casing illustrating a mail item ejection drive.

Rotation of the rotatable member may be effected by an electricmotor housed in the base 10, however for low cost compact machines it is preferred to provide for manual operation. This is provided by a bar 22 which extends across the front of the machine between the side casings 11, 12. As shown in FIGS. 2 and 3, the bar 22 is supported in casing 11 by a lever 23 pivoted at 24 and in casing 12 by a lever 25 pivoted at 26. The lever 23 is formed with an arc of teeth 27 which mesh with a first pinion 28 freely rotatable on an axis concentric with the axis of rotation of the rotatable member. The first pinion 28 meshes with a second pinion 29. A third pinion 30 concentric with and coupled to the second pinion 29 meshes with a fourth pinion 31 concentric with the axis of rotation of the first pinion 28 and coupled to the rotatable member. By applying manual pressure to depress the bar 22, the bary may be moved down to the position indicated at 32. This movement causes the arc of teeth 27 to rotate the first pinion 28 counterclockwise and hence the second and third pinions 29, 30 rotate clockwise and the latter drives the fourth pinion 31 in a counterclockwise direction. As a result, the rotatable member is rotated in a direction to effect printing of a franking. A spring, not shown, returns the bar to its initial position when it is released. In order to prevent the rotatable member being rotated in the reverse direction during this movement of the bar 22, a one way clutch is provided in the coupling between the second and third pinions 29, 30 or between the fourth pinion 31 and the rotatable member. The ratios between the teeth of the pinions are so chosen that a single depression of the bar to the position 32 will result in rotation of the rotatable member through an angle of 360 degrees.

Generally the circumference of the printing drum 15 will be less than the length of an envelope on which the franking is to be printed. As a result, after a single rotation of the print drum, the trailing end of the envelope lies beneath the print drum. In order to eject the envelope from the machine a pressure roll 33 located under the platform 13 is driven, in a counterclockwise direction as seen in FIG. 3, during the return movement of the bar 22. This is accomplished by a belt and pulley drive in the casing 12. A pulley 34 is secured to the shaft of the pressure roll 33 and is driven by belt 35 passing round pulley 36 freely rotatable on the casing 12. A further belt 37 passes around a further groove in the pulley 36 and a further pulley 38 also freely rotatable on the casing 12. The further belt 37 is secured to the lever 25 at a point 39. During downward movement of the bar 22 the attachment of the belt 37 to the lever 25 causes clockwise rotation of the pulleys and this would produce undesired clockwise rotation of the pressure roll 33. To prevent this undesired rotation of the pressure roll 33, the pressure roll 33 is coupled to the pulley 34 through a one way clutch. During movement of the bar 22 to its initial position, the belt 37 is driven by its connection with the lever 22 and causes counterclockwise rotation of the pulleys. This direction of rotation of the pulley 34 causes the one way clutch to transmit drive to the pressure roll 33. The pressure roll is resiliently biassed against the print drum so as to press the envelope against the print elements. The pressure roll also bears against further small rollers immediately adjacent the print drum so that when the print drum ceases rotation, when the bar 22 reached position 32, the gripping of the envelope between the pressure roll 33 and the further small rollers permits the envelope to be fed out of the machine by the rotation of the pressure roll during return movement of the bar 22.

A drum cover 40 (FIG. 10 provides a safe-guard to security of access to the print wheels 17. The cover is locked in a closed position during rotation of the print drum and in addition there is a further inner cover (not shown) to protect the print wheels when the drum 15 is in its normal rest position.

We claim:

1. A franking machine comprising:

(a) a base member;

(b) a rotatable member mounted for rotation on said base member, said rotatable member including a print drum carrying selectively settable printing elements, input means settable to a desired value of franking to be printed, print element setting means operative in response to said input means to set the printing elements to the value set by the input means, accounting means responsive to the setting of the input means to register the selected franking value, to carry out functions in relation to said selected franking value and to generate a control signal if the selected franking value is permitted to be printed; and (c) control means normally inhibiting rotation of the rotatable member relative to said base member and operative in response to said control signal to free the rotatable member for rotation relative to said base member to effect printing of the selected franking value.

2. A franking machine as claimed in claim 1 in which the accounting means comprises electronic logic circuits operative to register the selected franking value and the accumulated sum of franking values printed by the machine.

3. A franking machine as claimed in claim 2 in which the accounting means includes a register to record a value of credit available for use in franking.

4. A franking machine as claimed in claim 1 including display means carried on the rotatable member operable to display items of data.

5. A franking machine as claimed in claim 4 in which the display means is operable to display data relating to the functioning of the machine.

6. A franking machine as claimed in claim 1 including manually operable drive means to rotate the rotatable member to effect a franking operation.

7. A franking machine as claimed in claim 1 including an electrically powered motor operable to rotate the rotatable member to effect a franking opertion.

8. A franking machine as claimed in claim 1 in which the accounting and control means is powered by an electric battery housed within the rotatable member.

9. A franking machine as claimed in claim 1 wherein said control means includes a catch on said rotatable member normally engaging said base member to inhibit rotation of said rotatable member relative to the base member, said catch being released by the control signal to free the rotatable member for rotation relative to the base member.

10. A franking machine as claimed in claim 1 wherein said input means comprises a plurality of slidable keys and said print element setting means comprises a corresponding plurality of bars connected at one end thereof directly to said respective keys and extending from said keys to said print elements.

11. A franking machine comprising:

(a) a base member;

(b) a rotatable member mounted for rotation on said base member, said rotatable member including a print drum carrying selectively settable printing elements, input means settable to a desired value of franking to be printed, print element setting means operative in response to said input means to set the printing elements to the value set by the input means, accounting means responsive to the setting of the input means to register the selected franking value, to carry out accounting functions in relation to said selected franking value and to generate a control signal if the selected franking value is permitted to be printed;

(c) control means normally inhibiting rotation of the rotatable member on said base member and operative in response to said control signal to free the rotatable member for rotation to effect printing of the selected franking value; and (d) manually operable drive means to rotate the rotatable member to effect a franking operation, said manually operable drive means including a lever rotatable about a pivot on said base member, drive means mechanically coupling said lever to the rotatable member, said drive means being operative upon movement of said lever from a rest position to an operated position to rotate said rotatable member to effect printing of the selected franking value and said drive means including a one way clutch operative to permit return of said lever from said operated position to said rest position without rotation of said rotatable member.

12. A franking machine as claimed in claim 11 wherein said lever carries a row of teeth extending in an arc concentric with said pivot; said drive means includes a train of gear wheels, one of said gear wheels meshing with said row of teeth.

13. A franking machine as claimed in claim 11 including feed means coupled to said lever; said feed means being operated by return of said lever from the operated position to the rest position to eject from the machine a mail item upon which the selected franking value has been printed.

14. A franking machine as claimed in claim 13 wherein said feed means includes a pressure roll engaging the print drum at a printing position and means operated by return of the lever from the operated position to the rest position to rotate the pressure roll.

15. A franking machine as claimed in claim 14 wherein the means operated by return of the lever includes two pulleys mounted at spaced locations on said base member; a belt extending around said pulleys; a connection between said lever and said belt operative to move the belt to rotate said pulleys; and further means including a one way clutch coupling one of said pulleys to said pressure roll.

* * * * *